US006758690B1

(12) United States Patent
Yu et al.

(10) Patent No.: US 6,758,690 B1
(45) Date of Patent: Jul. 6, 2004

(54) ELECTROSTATIC DISCHARGE PROTECTION SHIELD DEVICE

(75) Inventors: Yat Shu (Damien) Yu, Burnaby (CA); Kenny Veng Hong Che, Vancouver (CA); Holger Janssen, Richmond (CA); Reza Ahmadian Yazdi, Richmond (CA); Alec Ho, Coquitlam (CA); Ian Liu, Vancouver (CA)

(73) Assignee: VTech Telecommunications Limited, Tai Po (HK)

( * ) Notice: Subject to any disclaimer, the term of this patent is extended or adjusted under 35 U.S.C. 154(b) by 0 days.

(21) Appl. No.: 10/337,608

(22) Filed: Jan. 7, 2003

(51) Int. Cl.[7] ..... H01R 13/44
(52) U.S. Cl. ..... 439/140; 439/181
(58) Field of Search ..... 439/140, 141, 439/181, 274, 284, 186, 187

(56) References Cited

U.S. PATENT DOCUMENTS 5,002,495 A * 3/1991 Tanaka ..... 439/108

* cited by examiner

*Primary Examiner*—P. Austin Bradley
*Assistant Examiner*—Phuongchi Nguyen
(74) *Attorney, Agent, or Firm*—Shaw Pittman LLP

(57) ABSTRACT

An electrostatic discharge protection shield device, which may be used in bases or cradles for mobile electronic apparatus, among other uses. A grounded electrostatic discharge shield is movable between two positions, one which precludes contact with data/dc power contacts of a data/dc power connection and another, in which the contacts are exposed for normal operation in connection with the parent electronic apparatus.

22 Claims, 5 Drawing Sheets

ELECTROSTATIC DISCHARGE PROTECTION SHIELD DEVICE

BACKGROUND OF THE INVENTION

1. Field of the Invention

The present invention relates to devices for preventing damage to electronic devices caused by electrostatic discharge (ESD), and in particular the invention relates to devices for preventing ESD-caused damage to portable electronic devices, such as cordless or cellular telephones and their bases or cradles, during their placement and removal from charging cradles, interface cables or other handling.

2. The Prior Art

Electronic devices are often susceptible to failure due to ESD. The risk of such damage is particularly great for devices that are directly handled by individuals on a regular basis, such as many portable electronic devices. Increasing the risk of ESD damage even further is the provision of a connector or electrical interface port on such portable electronic devices. For example, cordless and cellular telephones and/or their bases or cradles, are often susceptible to damage from ESD when the handset is placed on or removed from charging cradles or when connections are made or broken to data ports on the mobile electronic apparatus, or during other accidental or intentional contact. Protection from ESD becomes a larger concern when data ports are present, inasmuch as such mobile electronic apparatus typically contain circuitry that is particularly sensitive to damage, such as ASIC modules. In order to prevent damage from occurring, typical prior art mobile electronic apparatus, if protected at all, employ internal ESD protection circuitry, which can add to the size and/or cost of the circuitry package of the apparatus.

It would be desirable to provide a simplified, low cost device for protecting electronic devices, particularly those provided with charging and/or data ports, from damage caused by ESD.

It would also be desirable to provide a device for protection against damage to an electronic device caused by ESD, which does not otherwise interfere with the normal operation of the electronic device.

These and other desirable characteristics of the present invention will become apparent in view of the present specification and drawings.

SUMMARY OF THE INVENTION

The present invention is directed to an electrostatic discharge protection shield apparatus for an electrical connector for a corresponding electronic apparatus. The electrostatic discharge protection shield apparatus comprises a non-electrically conductive base for supporting the electrical connector; and an electrically conductive shield member, movably mounted on the base. The electrically conductive shield member is movable between a first position relative to the electrical connector, in which the electrically conductive shield member substantially protects the electrical connector from undesired contact, and a second position relative to the electrical connector, in which the electrically conductive shield member exposes the electrical connector for normal operation in contact with the corresponding electronic apparatus. A biasing mechanism prompts the electrically conductive shield member into its first position. The biasing structure is configured to resistively yield and permit movement of the electrically conductive shield member toward its second position, upon exertion of force on the electrically conductive shield member in excess of a predetermined amount.

Preferably, the electrical connector has an axis, and the electrically conductive shield member is configured to move parallel to the axis of the electrical connector.

In a preferred embodiment of the invention, the electrical connector has a dimension in a direction parallel to its axis which is greater than a corresponding dimension of the electrically conductive shield member extending in a direction parallel to the axis of the electrical connector. The electrostatic discharge protection shield apparatus would further comprise an aperture, disposed in the electrically conductive shield member, and having an axis parallel to the axis of the electrical connector, through which the electrical connector is configured to pass, so that when the electrically conductive shield member is in its first position, it surrounds an end of the electrical connector where electrical contacts are situated, and when the electrically conductive shield member is in its second position, the end of the electrical connector where electrical contacts are situated is exposed.

Preferably, the electrostatic discharge protection shield apparatus further comprises at least one guide member, operably associated with the base and extending parallel to the axis of the electrical connector; and at least one guide member receiving aperture disposed in the electrically conductive shield member, for constraining the movement of the electrically conductive shield member to be in a direction parallel to the axis of the electrical connector.

In a preferred embodiment of the invention, the biasing mechanism comprises a coil spring, under compression, disposed between the non-electrically conductive base and the electrically conductive shield member, so that the coil spring tends to push the electrically conductive shield member away from the non-electrically conductive base. Structure operably associated with the base limits the distance away from the non-electrically conductive base that the biasing mechanism can push the electrically conductive shield.

Preferably, the electrostatic discharge protection shield apparatus further comprises an electrical ground, operably configured to remain in continuous contact with the electrically conductive shield member, throughout the movement of the electrically conductive shield member between its first and second positions, for permitting conduction of electrostatic discharges away from the electrical connector.

In a preferred embodiment of the invention, the electrical ground comprises the biasing mechanism being fabricated at least in part from electrically conductive material.

DETAILED DESCRIPTION OF THE DRAWINGS

Figure 1:
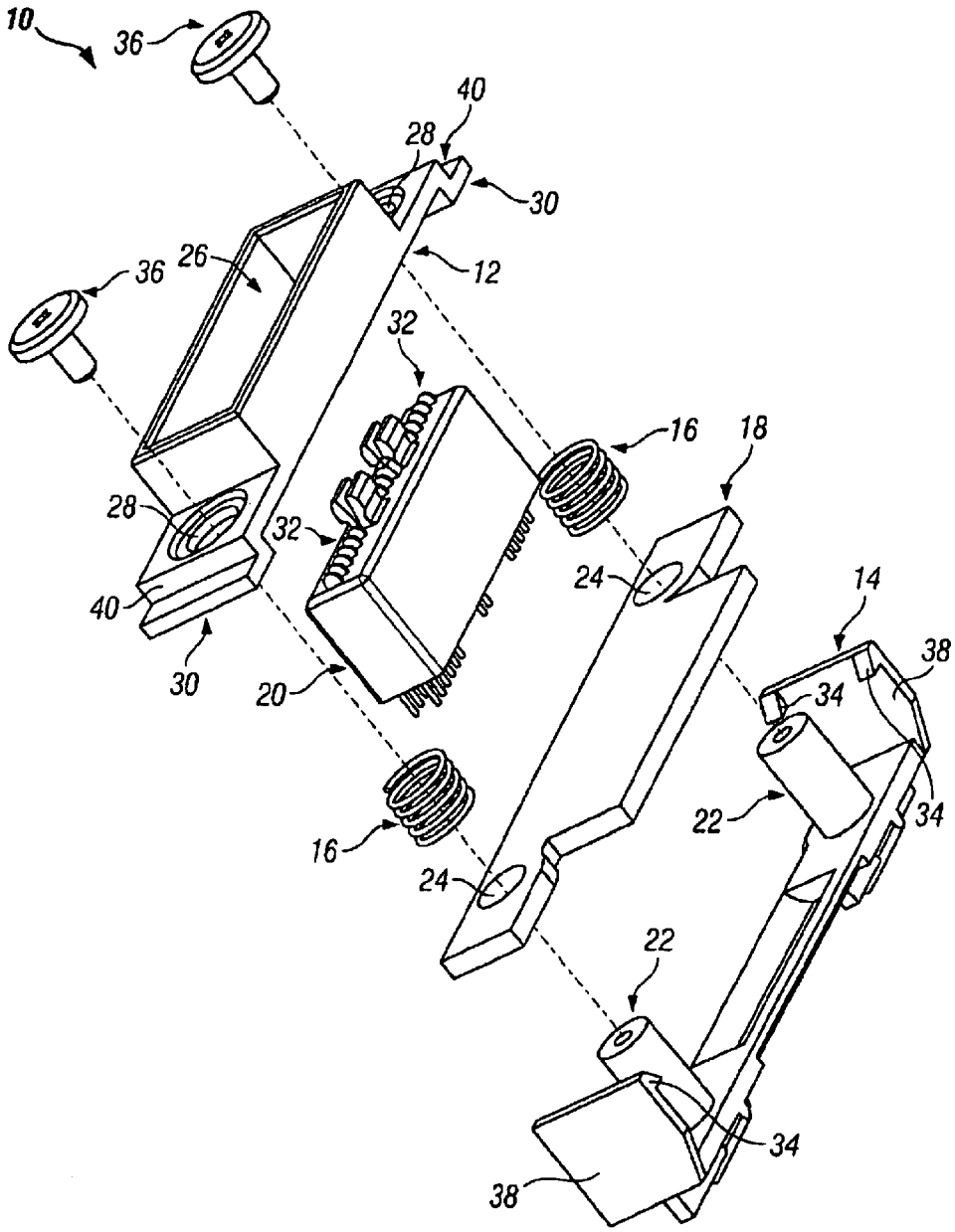
FIG. 1 is a perspective exploded view of the electrostatic discharge protection shield device, according to a first embodiment of the present invention.

While this invention is susceptible of embodiment in many different forms, there are shown in the drawings and will be described in detail, several specific embodiments, with the understanding that the present disclosure is to be considered as an exemplification of the principles of the invention and is not intended to limit the invention to the embodiments illustrated.

The problem addressed by the present invention is the need for electrostatic discharge (ESD) protection for data and dc power connectors for electronic apparatus, such as wireless telephones and personal digital assistants (PDAs) which are placed onto and removed from cradles, for recharging and/or simultaneous data transfer, to a personal computer, for example. If such protection is not provided, a large electrostatic discharge can occur (e.g., from human touch) when the telephone or PDA is placed onto or removed from its cradle, or during other intentional or even accidental contact or handling, that may lead to potential damage to the electronic circuitry and ASIC (Application Specific Integrated Circuits) with which the data and dc power connector interfaces. This may lead to failure of the entire electronic apparatus. Therefore an ESD shield is necessary to attract and divert any electrostatic discharge from an outside source before contact with the connector is made. The shield also must not interfere with the interface of the data, audio and dc power connector and the parent electronic apparatus.

FIG. 1 is a perspective exploded view of the electrostatic discharge protection shield device of the present invention. The ESD protection shield device 10 of the present invention includes conductive ESD ring 12; connector stand 14; two conductive coil springs 16; printed circuit board (PCB) 18 into which data/dc power connector 20 will be plugged. As such, the shape and configuration of connector 20 will be defined by the particular electronic apparatus, and will thus, in turn, influence the configuration of ESD ring 12 and its associated components. The plastic connector stand 14 has two vertically protruding screw posts 22, that extend upwardly from the base of the connector stand 14. ESD ring 12 is fabricated from, or at least coated with, any suitable electrically conductive material. Connector stand 14 is preferably molded from non-electrically conductive plastic material, but any suitable non-electrically conductive material may be used. Coil springs 16 are fabricated from any suitable conductive metallic material, having in addition to the requisite conductivity characteristics, spring performance and durability characteristics as may be deemed appropriate to meet the requirements for any individual application. Likewise, the shape and configuration of the individual components making up device 10 may be suitably configured, by one of ordinary skill in the art, having the present disclosure before them, to accommodate the specific configuration of the connector 20, which is defined by the particular electronic apparatus.

When ESD protection shield device 10 is assembled (FIG. 2), the data/dc power connector 20 is mounted directly onto PCB 18. Other ESD-sensitive electronic components (not shown) that are protected by the present arrangement are also mounted onto, or electrically connected, to PCB 18. The two coil springs 16 fit around the screw posts 22 of the connector stand, which screw posts 22 pass through apertures 24 of PCB 18, and apertures 28 of ESD ring 12. Coil springs 16 sit between the top of the PCB and the bottom of the flat portion of the ESD ring. The ESD ring 12 has a central opening 26 that is sized to insertingly receive data/dc power connector 20 as well as the screw posts 22, but will be provided with adequate clearance such that ring 12 can slide vertically relative to data/dc connector 20 without frictional resistance. The coil springs 16 provide an upward bias force against the underside of flanges 30 of ring 12, such that the top of the ESD ring will protrude slightly above any pin contacts 32 of the data/dc power connector 20. This will ensure that a large ESD source will likely contact the ESD ring 12 first, prior to contact with the pins 32 of the connector 20.

The ESD ring 12 will be grounded via the coil springs 16 to a ground (not shown, but suitably connected as can be accomplished by one of ordinary skill in the art of mobile electronic apparatus, having the present disclosure before them), such that the discharge will not damage any electronic circuitry or ASIC modules that the data/dc power connector 20 is connected to. Optional snap-fit clips 34, on flanges 38, may be provided on connector stand 14 to retain ring 12 in place, by snapping past the outer edges of flanges 30, and coming to rest in notches 40, as ring 12 is pushed down onto screw posts 22, as an alternative to or in addition to the placement of screws 36 on screw posts 22, to limit the height at which the ESD ring 12 rests, as it is being pushed up by the springs 16.

The vertical motion of the ESD ring 12 provided by the springs 16 and screw posts 22 will allow ring 12 to move below the pins 32 of the connector 20, so that the ESD ring 12 does not interfere with the intended mechanical interface of the data/dc power connector 20 to an external (parent) mobile electronic apparatus (not shown). The solid height of the coil springs 16 at maximum compression (not shown) will define the lowest point of travel of the ESD ring 12, as reflected in FIGS. 3 and 5.

Figure 2:
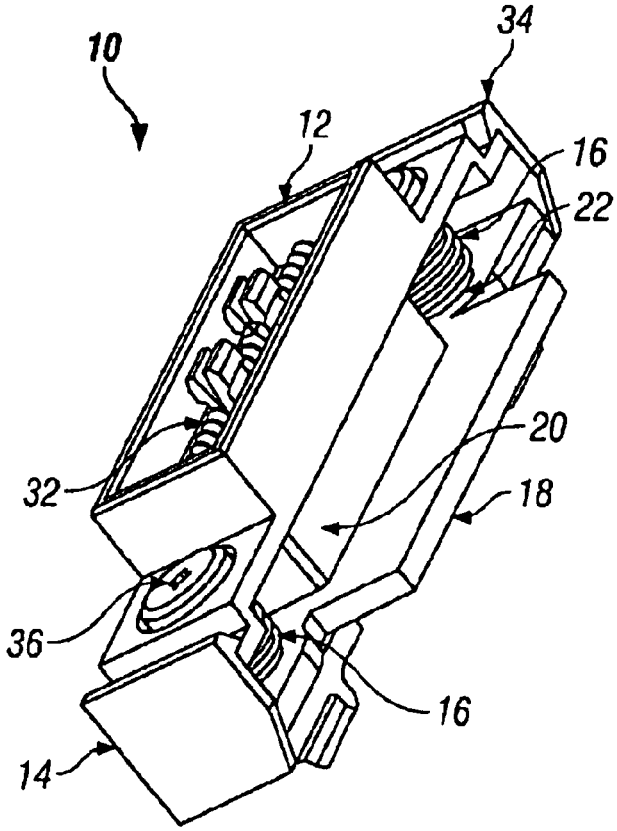
FIG. 2 is a perspective assembled view of the electrostatic discharge protection shield device of the embodiment of FIG. 1, shown in its uncompressed mode.

FIG. 2 illustrates the ESD protection shield device 10 in its assembled configuration, in which the ring 12 is at its upper end of its range of motion, reflecting the normal, upwardly biased, uncompressed orientation.

Figure 3:
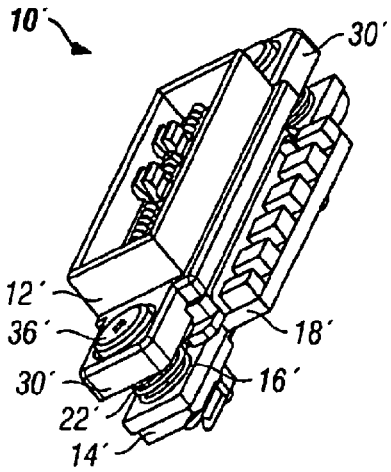
FIG. 3 is a perspective view of the electrostatic discharge protection shield device according to an alternative embodiment of the present invention, as assembled, in its at-rest uncompressed mode.
Figure 4:
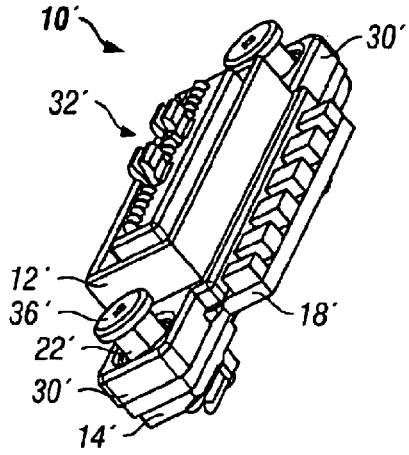
FIG. 4 is a perspective view of the electrostatic discharge protection shield device of the present invention, according to the embodiment of FIG. 3, as assembled, in its compressed mode.

FIG. 3 is a perspective view of the electrostatic discharge protection shield device 10' according to an alternative embodiment of the present invention, as assembled, in its at-rest uncompressed mode. In this embodiment, structures analogous in structure and function to those in the embodiment of FIG. 1 are given like reference numerals augmented by a prime (').  The snap-fit clips 34 and flanges 34 are omitted, and the flanges 30' are modified to omit the notches 40 shown in FIG. 1. Instead, ring 12' is held in place over PCB 18' by screws 36' engaging screw posts 22' emanating from connector base 14' passing through apertures in flanges 30'. Ring 12' is held in its upwardly biased, uncompressed position by coil springs 16'. FIG. 4 is a perspective view of the electrostatic discharge protection shield device 10' of the embodiment of FIG. 3, as assembled, in its compressed mode, as it would appear, if visible, when being pushed down by a parent mobile electronic apparatus (not shown).

Figure 5:
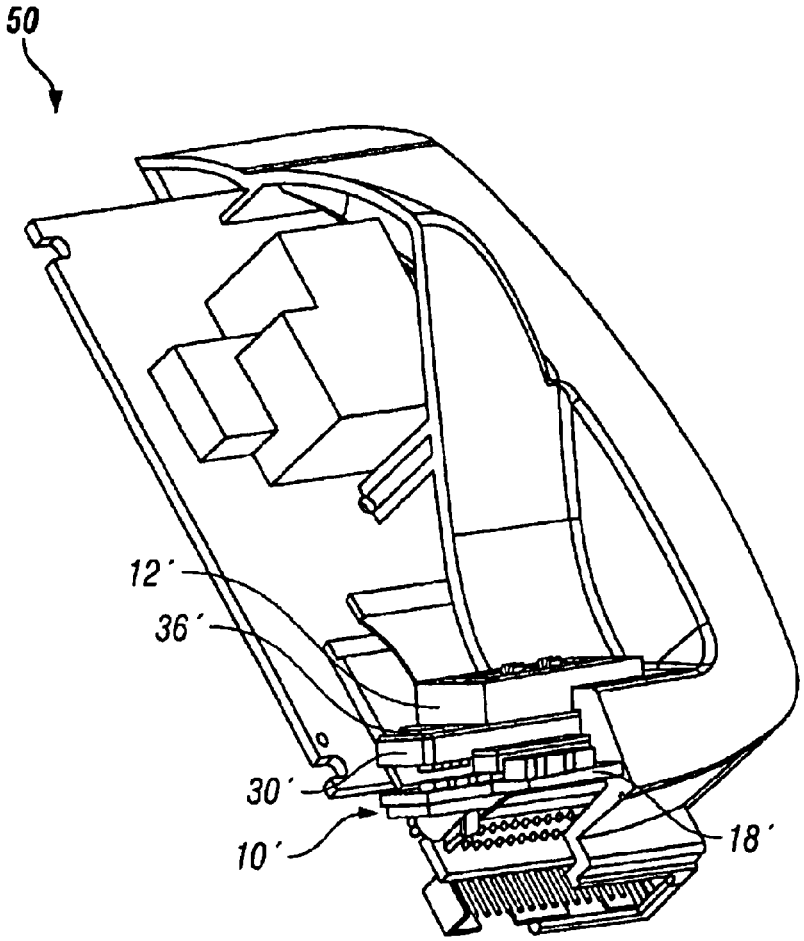
FIG. 5 is a perspective, cutaway view of a representative data/dc power connection cradle, having the electrostatic discharge protection shield device of the present invention, according to the alternative embodiment of FIGS. 3 and 4, shown in its at-rest uncompressed mode.

FIG. 5 is a perspective, cutaway view of a representative data/dc power connection cradle 50, having the electrostatic discharge protection shield device 10' of the embodiment of FIGS. 3–4 of the present invention, shown in its at-rest uncompressed mode, in which ring 12' is at the upper end of its range of motion. In this embodiment, structures analogous in structure and function to those in the embodiment of FIG. 1 are given like reference numerals augmented by a prime (')). It is to be understood that cradle 50 is simply a representative illustration, and that electrostatic discharge protection shield device 10' (or 10) may be employed in a wide variety of cradles, power or data stations, of many different configurations.

Figure 6:
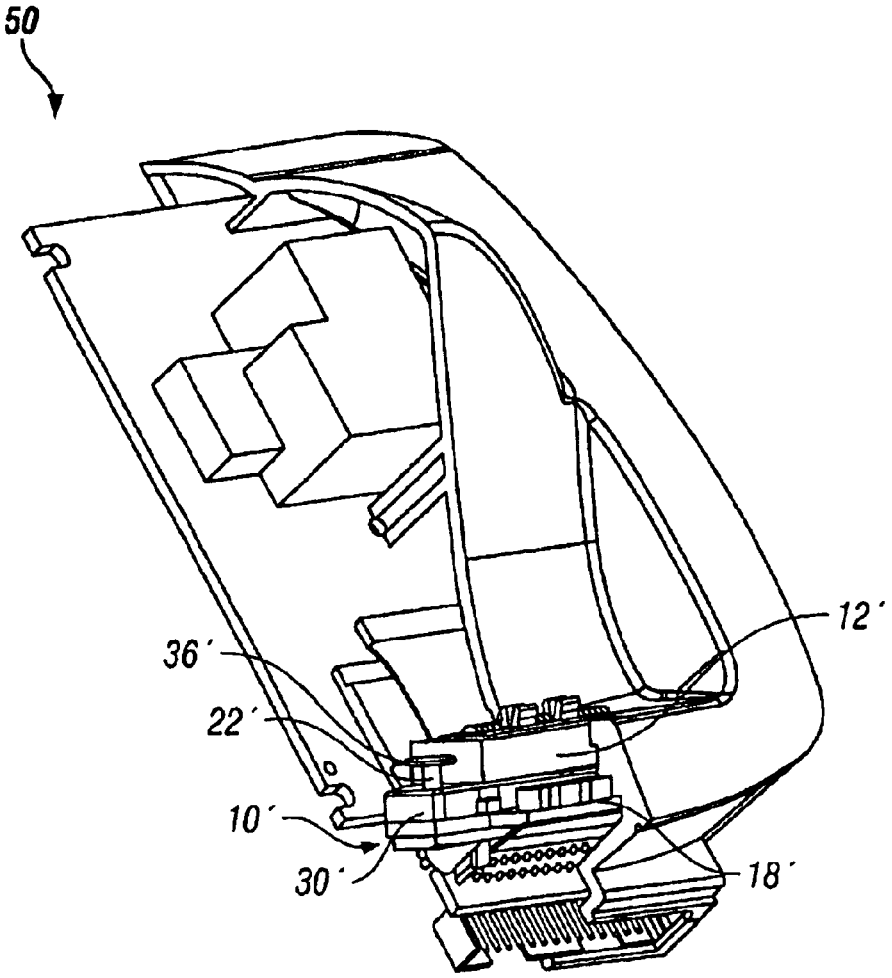
FIG. 6 is a perspective, cutaway view of a representative data/dc power connection cradle, having the electrostatic discharge protection shield device of the present invention, according to the alternative embodiment of FIGS. 3–5, shown in its compressed mode.

FIG. 6 is a perspective, cutaway view of representative data/dc power connection cradle 50, having the electrostatic discharge protection shield device of the present invention, shown in its compressed mode, such as when it is pressed down by an (unseen) parent mobile electronic apparatus. Shield 12' is shown at the lower end of its range of motion, against PCB 18', revealing screw post 22' and screw 36'.

The ESD protection shield devices of the present invention can be used on a wide variety of electronic apparatus that require external ESD protection at an exposed location of an electrical interface.

The advantage of this invention is that ESD protection is possible when internal circuitry or connector limitations do not allow for conventional ESD protection devices. Also the large conductive ESD Ring of the present invention is believed to be more effective at directly attracting discharges away from the connector itself, without compromising the connector's intended functionality. This is achieved through the ESD shield's ability to retract away when the parent electronic apparatus is interfaced with the connector, and return to its protective position when the parent apparatus is removed.

The benefits of this invention include that it is capable of providing ESD protection to both a data connector and to a power connector. It is believed to be more cost effective as compared to conventional, built-in protection within the circuitry of the parent electronic apparatus, which typically can only protect power connections, such as charge contacts. Also, because of the large ESD attractive plating used, it is more effective in directly diverting electrostatic discharge away from the connector. This is particularly important when dealing with data connections.

The foregoing description and drawings merely explain and illustrate the invention and the invention is not limited thereto, as those skilled in the art who have the disclosure before them will be able to make modifications and variations therein without departing from the scope of the invention.

What is claimed is:

1. An electrostatic discharge protection shield apparatus for an electrical connector for a corresponding electronic apparatus, the electronic discharge protection shield apparatus comprising:

a non-electrically conductive base for supporting the electrical connector, wherein the electrical connector has an axis;

an electrically conductive shield member, movably mounted on the base, wherein the electrically conductive shield member is configured to move parallel to the axis of the electrical connector;

the electrically conductive shield member being movable between a first position relative to the electrical connector, in which the electrically conductive shield member substantially protects the electrical connector from undesired contact, and a second position relative to the electrical connector, in which the electrically conductive shield member exposes the electrical connector for normal operation in contact with the corresponding electronic apparatus; and a biasing mechanism for prompting the electrically conductive shield member into its first position, the biasing mechanism being configured to resistively yield and permit movement of the electrically conductive shield member toward its second position, upon exertion of force on the electrically conductive shield member in excess of a predetermined amount.

2. The electrostatic discharge protection shield apparatus according to claim 1, wherein the electrical connector has a dimension in a direction parallel to its axis which is greater than a corresponding dimension of the electrically conductive shield member extending in a direction parallel to the axis of the electrical connector, the electrostatic discharge protection shield apparatus further comprising:

an aperture, disposed in the electrically conductive shield member, and having an axis parallel to the axis of the electrical connector, through which the electrical connector is configured to pass, so that when the electrically conductive shield member is in its first position, it surrounds an end of the electrical connector where electrical contacts are situated, and when the electrically conductive shield member is in its second position, the end of the electrical connector where electrical contacts are situated is exposed.

3. The electrostatic discharge protection shield apparatus according to claim 1, further comprising:

at least one guide member, operably associated with the base and extending parallel to the axis of the electrical connector;

at least one guide member receiving aperture disposed in the electrically conductive shield member, for constraining the movement of the electrically conductive shield member to be in a direction parallel to the axis of the electrical connector.

4. The electrostatic discharge protection shield apparatus according to claim 1, wherein the biasing mechanism comprises:

a coil spring, under compression, disposed between the non-electrically conductive base and the electrically conductive shield member, so that the coil spring tends to push the electrically conductive shield member away from the non-electrically conductive base.

5. The electrostatic discharge protection shield apparatus according to claim 4, further comprising:

structure operably associated with the base for limiting a distance away from the non-electrically conductive base that the biasing mechanism can push the electrically conductive shield member.

6. The electrostatic discharge protection shield apparatus according to claim 1, further comprising:

an electrical ground, operably configured to remain in continuous contact with the electrically conductive shield member, throughout the movement of the electrically conductive shield member between its first and second positions, for permitting conduction of electrostatic discharges away from the electrical connector.

7. The electrostatic discharge protection shield apparatus according to claim 6, wherein the electrical ground comprises:

the biasing mechanism being fabricated at least in part from electrically conductive material.

8. An electrostatic discharge protection shield apparatus, comprising:

a non-electrically conductor stand for supporting an electrical connector of an electronic apparatus, wherein the non-electrically conductor stand includes a base and at least one guide member extending upwardly from the base, wherein the at least one guide member is substantially perpendicular to the base;

an electrically conductive shield member moveably mounted on the non-electrically conductor stand, wherein the electrically conductive shield member comprises at least one aperture for receiving the at least one guide member;

the electrically conductive shield member being movable between a first position relative to the electrical connector, in which the electrically conductive shield member substantially protects the electrical connector from undesired contact, and a second position relative to the electrical connector, in which the electrically conductive shield member exposes the electrical connector for normal operation in contact with the corresponding electronic apparatus; and a biasing mechanism for prompting the electrically conductive shield member into its first position, the biasing mechanism being configured to resistively yield and permit movement of the electrically conductive shield member toward its second position, upon exertion of force on the electrically conductive shield member in excess of a predetermined amount.

9. The electrostatic discharge protection shield apparatus according to claim 8, wherein the electrical connector has an axis, and wherein the electrically conductive shield member is configured to move parallel to the axis of the electrical connector.

10. The electrostatic discharge protection shield apparatus according to claim 9, wherein the electrical connector has a dimension in a direction parallel to its axis which is greater than a corresponding dimension of the electrically conductive shield member extending in a direction parallel to the axis of the electrical connector, the electrostatic discharge protection shield apparatus further comprising:

an aperture, disposed in the electrically conductive shield member, and having an axis parallel to the axis of the electrical connector, through which the electrical connector is configured to pass, so that when the electrically conductive shield member is in its first position, it surrounds an end of the electrical connector where electrical contacts are situated, and when the electrically conductive shield member is in its second position, the end of the electrical connector where electrical contacts are situated is exposed.

11. The electrostatic discharge protection shield apparatus according to claim 8, wherein the biasing mechanism comprises:

a coil spring, under compression, disposed between the non-electrically conductor stand and the electrically conductive shield member, so that the coil spring tends to push the electrically conductive shield member away from the non-electrically conductor stand.

12. The electrostatic discharge protection shield apparatus according to claim 11, further comprising:

structure operably associated with the base for limiting a distance away from the non-electrically conductor stand that the biasing mechanism can push the electrically conductive shield member.

13. The electrostatic discharge protection shield apparatus according to claim 8, further comprising:

an electrical ground, operably configured to remain in continuous contact with the electrically conductive shield member, throughout the movement of the electrically conductive shield member between its first and second positions, for permitting conduction of electrostatic discharges away from the electrical connector.

14. The electrostatic discharge protection shield apparatus according to claim 13, wherein the electrical ground comprises:

the biasing mechanism being fabricated at least in part from electrically conductive material.

15. An electrostatic discharge protection shield apparatus, comprising:

a non-electrically conductive base;

an electrically conductive shield member, movably mounted on the base;

a printed circuit board mounted between the electrically conductive shield member and the non-electrically conductive base;

the electrically conductive shield member being movable between a first position relative to the electrical connector, in which the electrically conductive shield member substantially protects the electrical connector from undesired contact, and a second position relative to the electrical connector, in which the electrically conductive shield member exposes the electrical connector for normal operation in contact with the corresponding electronic apparatus; and a biasing mechanism for prompting the electrically conductive shield member into its first position, the biasing mechanism being configured to resistively yield and permit movement of the electrically conductive shield member toward its second position, upon exertion of force on the electrically conductive shield member in excess of a predetermined amount.

16. The electrostatic discharge protection shield apparatus according to claim 15, wherein the biasing mechanism comprises:

a coil spring, under compression, disposed between the non-electrically conductive base and the electrically conductive shield member, so that the coil spring tends to push the electrically conductive shield member away from the non-electrically conductive base.

17. The electrostatic discharge protection shield apparatus according to claim 16, further comprising:

structure operably associated with the base for limiting a distance away from the non-electrically conductive base that the biasing mechanism can push the electrically conductive shield member.

18. The electrostatic discharge protection shield apparatus according to claim 15, further comprising:

an electrical ground, operably configured to remain in continuous contact with the electrically conductive shield member, throughout the movement of the electrically conductive shield member between its first and second positions, for permitting conduction of electrostatic discharges away from the electrical connector.

19. The electrostatic discharge protection shield apparatus according to claim 18, wherein the electrical ground comprises:

the biasing mechanism being fabricated at least in part from electrically conductive material.

20. The electrostatic discharge protection shield apparatus according to claim 15, wherein the electrical connector has an axis, and wherein the electrically conductive shield member is configured to move parallel to the axis of the electrical connector.

21. The electrostatic discharge protection shield apparatus according to claim 20, wherein the electrical connector has a dimension in a direction parallel to its axis which is greater than a corresponding dimension of the electrically conductive shield member extending in a direction parallel to the axis of the electrical connector, the electrostatic discharge protection shield apparatus further comprising:

an aperture, disposed in the electrically conductive shield member, and having an axis parallel to the axis of the electrical connector, through which the electrical connector is configured to pass, so that when the electrically conductive shield member is in its first position, it surrounds an end of the electrical connector where electrical contacts are situated, and when the electrically conductive shield member is in its second position, the end of the electrical connector where electrical contacts are situated is exposed.

22. The electrostatic discharge protection shield apparatus according to claim 20, further comprising:

at least one guide member, operably associated with the base and extending parallel to the axis of the electrical connector;

at least one guide member receiving aperture disposed in the electrically conductive shield member, for constraining the movement of the electrically conductive shield member to be in a direction parallel to the axis of the electrical connector.

* * * * *

UNITED STATES PATENT AND TRADEMARK OFFICE

CERTIFICATE OF CORRECTION

PATENT NO. : 6,758,690 B1
DATED : July 6, 2004
INVENTOR(S) : Yu et al.

It is certified that error appears in the above-identified patent and that said Letters Patent is hereby corrected as shown below:

Title page,
Item [75], Inventors, "Yat Shu (Damien) Yu" should be -- Yat Shun (Damien) Yu --.

Signed and Sealed this

Twenty-fifth Day of April, 2006

JON W. DUDAS
*Director of the United States Patent and Trademark Office*